US005425048A

United States Patent [19]

Heine et al.

[11] Patent Number: 5,425,048

[45] Date of Patent: Jun. 13, 1995

[54] HEATING APPARATUS FOR INDUCTION LADLE AND VACUUM FURNACES

[75] Inventors: Hans G. Heine, Red Bank, N.J.; Nicolas P. Cignetti, North Canton, Ohio

[73] Assignee: Inductotherm Corp., Rancocas, N.J.

[21] Appl. No.: 19,921

[22] Filed: Feb. 19, 1993

Related U.S. Application Data

[63] Continuation-in-part of Ser. No. 532,010, Jun. 1, 1990, Pat. No. 5,272,720, which is a continuation-in-part of Ser. No. 473,000, Jan. 31, 1990, Pat. No. 5,257,281.

[51] Int. Cl.[6] ..... H05B 6/22

[52] U.S. Cl. ..... 373/151; 373/156; 266/242; 266/275; 432/156

[58] Field of Search ..... 373/140, 141, 151, 152, 373/153, 155, 156; 266/242, 275, 276; 432/156, 157, 158, 262, 263, 264, 265

[56] References Cited

U.S. PATENT DOCUMENTS

| | | | |
|---|---|---|---|
| 1,879,360 | 9/1932 | Linnhoff | 373/156 |
| 2,929,906 | 3/1960 | Connelly | 219/10.79 |
| 3,004,091 | 10/1961 | Tama et al. | 373/151 |
| 3,177,282 | 4/1965 | Kasper et al. | 373/156 |
| 3,703,601 | 11/1972 | Babel | 373/163 |
| 4,183,508 | 1/1980 | Michelet et al. | 373/156 |
| 4,411,412 | 10/1983 | Lechervallier | 266/242 |
| 4,618,964 | 10/1986 | Larson et al. | 373/155 |
| 4,969,158 | 11/1993 | Larson et al. | 373/152 |
| 5,257,281 | 10/1993 | Cignetti et al. | 373/155 |
| 5,272,720 | 12/1993 | Cignetti et al. | 373/155 |

FOREIGN PATENT DOCUMENTS

| | | |
|---|---|---|
| 0053070 | 6/1982 | European Pat. Off. . |
| 0152849 | 8/1985 | European Pat. Off. . |
| 0232846 | 8/1987 | European Pat. Off. . |
| 2368542 | 5/1978 | France . |
| 2127333 | 12/1971 | Germany . |

OTHER PUBLICATIONS

Patent Abstracts of Japan, vol. 5, No. 112 (M-79) 21 Jul. 1981 & JP-A-56 053 868 (Fuji Denki Seizo K. L.) 13 May 1981.

*Primary Examiner*—Bruce A. Reynolds
*Assistant Examiner*—Tu Hoang
*Attorney, Agent, or Firm*—Seidel Gonda Lavorgna & Monaco

[57] ABSTRACT

An induction heating furnace is disclosed comprising an induction coil assembly and a ladle having a metallic shell that supports a crucible holding metal to be heated by the furnace. The ladle is readily separated from the induction coil assembly so that the heated metal may be conveniently and reliably moved among operational stations. The induction coil assembly has a preselected length which is less than the length of the shell. The induction coil assembly surrounds, but does not touch the shell and generates an electromagnetic induction field. The induction coil assembly comprises a coil, upper and lower yokes and an intermediate yoke coextensive with the coil. The upper and lower yokes are separated from each other and electromagnetically coupled together by the intermediate yoke. The upper, lower and intermediate yokes each comprise stacked laminates formed of sheets of ferrous material.

21 Claims, 8 Drawing Sheets

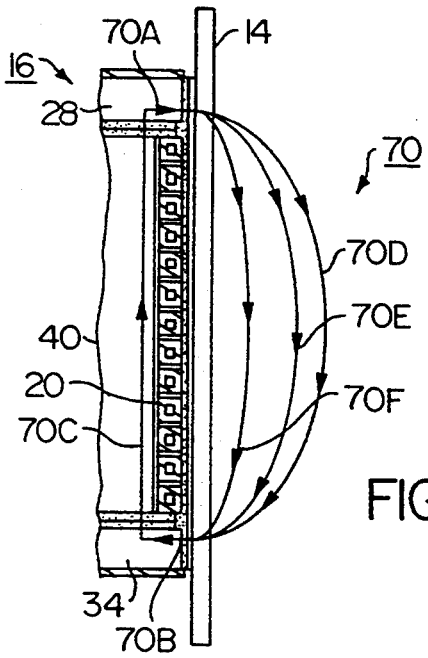
FIG. 5
FIG. 6b
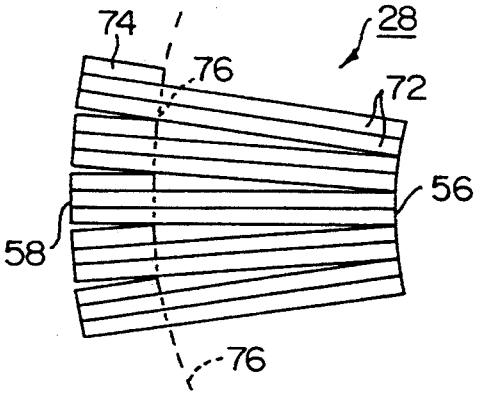
FIG. 6a
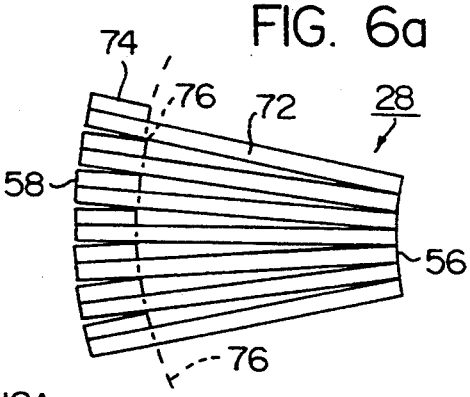
FIG. 7
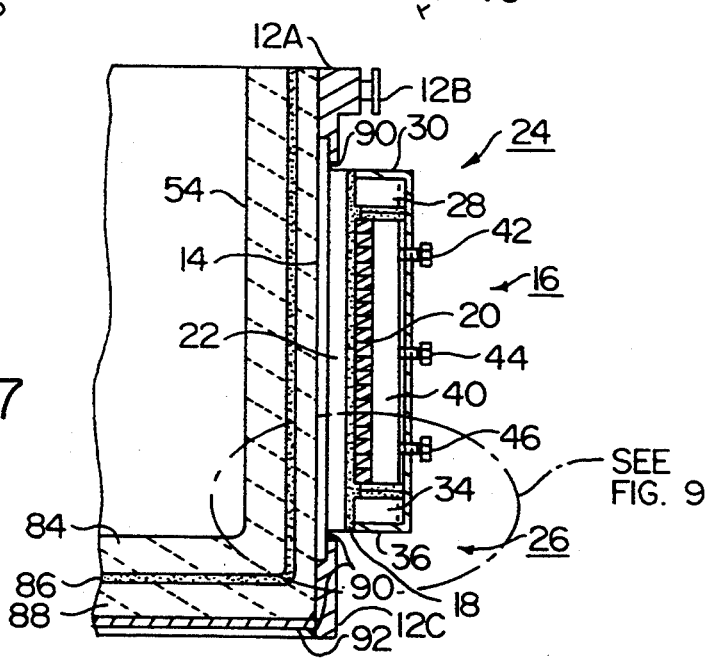

HEATING APPARATUS FOR INDUCTION LADLE AND VACUUM FURNACES

This is a continuation-in-part of application Ser. No. 07/532,010 filed on Jun. 1, 1990, now U.S. Pat. No. 5,272,720 which, in turn, is a continuation-in-part of application Ser. No. 07/473,000 filed Jan. 31, 1990, now U.S. Pat. No. 5,257,281. The disclosure of each of the U.S. applications Ser. Nos. 07/532,010 and 07/473,000 are herein incorporated by reference.

FIELD OF THE INVENTION

This invention relates to induction furnaces. More particularly, the invention is related to induction furnaces each having an induction coil assembly with yokes comprising stacked laminates and a ladle with a metallic shell comprising non-magnetic bars. The induction coil assembly and the shell both allow the electromagnetic field created by the induction coil assembly to be more advantageously delivered to the material being heated within each of the furnaces.

BACKGROUND OF THE INVENTION

Induction furnaces for melting or otherwise heating metal by generating magnetic fields which induce eddy currents to flow within and heat the metal are well known. One such induction furnace is the well-known "coreless" type having an induction coil assembly located external to the furnace itself. The induction coil assembly creates the magnetic flux which comprises the magnetic fields which, in turn, create the eddy currents to heat the metal. Typically, the metal to be heated by the furnace is contained by a liner which is of a refractory material. The eddy currents, induced by the magnetic fields generated by the induction coil assembly surrounding the liner, cause power ($I^2R$) to be dissipated in the metal, thereby increasing the temperature of the metal. In effect, for induction heating, the metal advantageously serves as its own heat source, thereby increasing the efficiency of the heating itself. The eddy currents are induced in the metal when alternating current is passed through the induction coil so as to generate an alternating magnetic field, or induction field.

The vessel in which the metal is heated must meet certain stringent physical standards. It must have a sufficiently high melting point so that it will not be melted by the heat of the metal, it must have a high strength to hold the weight of the metal, it must not interfere with the passage of magnetic flux from the induction coil through and around the metal, and in certain cases it must be removable from the induction coil assembly so that the melted metal within the vessel may be conveniently transported among various stations for pouring, holding, treating and other purposes.

The present invention is particularly well suited for heating vessels that are removable from induction coil assemblies. Removable heating vessels comprising a crucible are known and may be formed of a material, such as a ceramic. Ceramic, as is also known, is brittle and subject to stress cracking which may cause breaking of the ceramic, leading to "run out" of molten metal from the crucible. This "run out" poses a severe safety hazard to operating personnel. Thus, ceramic crucibles find little usage when the metal melted at one station needs to be transported in the same vessel to another station.

One way of strengthening a ceramic crucible is to surround it by a continuous metallic jacket, or shell typically of a metal having a relatively high temperature characteristic. However, since this type metal is either electrically conductive, magnetic, or weakened when heated, metallically supported ceramic crucibles by themselves do not offer much of an improvement over ceramic crucibles since the magnetic field generated by the induction coil assembly will heat the shell thereby reducing its mechanical integrity, while at the same time diverting energy away from the heating of the material. The magnetic field commonly causes a power loss ($I^2R$) while creating this self heating of the shell.

Thus there exists a definite need for a mechanically metal-jacketed induction heating vessel that overcomes the drawbacks of undesirable self heating of the jacket and the accompanying diversion of energy from the heating of the metal. The present invention provides such a heating vessel that does not divert energy away from heating the metal while at the same time does not suffer from any unnecessary self heating that might otherwise degrade its mechanical integrity. Further, the structurally rigid heating vessel of the present invention is easily removed from the induction coil assembly so that it may be conveniently transported between stations. The metallic shell that provides the structural support of the vessel is arranged in a predetermined manner relative to the induction coil assembly so as to obtain the benefits of the present invention. The metal-jacketed induction heating vessel of the present invention, commonly termed a ladle, is able to handle large quantities of metal at high operating temperatures. Furthermore, the ladle of the present invention, having its attendant benefits, is particularly suited for vacuum induction furnaces.

Typically, induction furnaces are provided with means for cooling the coils of the induction coil assembly and/or means for cooling the liner containing the metal. Sometimes, either or both types of cooling means are located where they intercept the electromagnetic fields generated by the induction coil assembly and, thereby as previously discussed, disadvantageously absorb or divert the flux of the magnetic fields away from its intended purpose of heating the molten metal. It is desirable to avoid cooling means located such that they interfere with the electromagnetic fields, so as to improve the heating efficiency of the induction furnaces.

All induction furnaces comprise a liner formed of a refractory material that contains molten metal within the furnaces. This refractory liner may have to be replaced sometime during the life of the induction furnace. It is desired that induction furnaces be provided with means that allows for easy access to and replacement of the refractory liner.

Accordingly, it is an object of the present invention to provide induction furnaces having means that facilitate the replacement of its crucible.

It is a further object of the present invention to provide induction furnaces having an induction coil assembly for generating, distributing and directing magnetic fields used for the heating of the metal in an improved manner, and a ladle that is readily removable from the induction coil assembly and has a metallic shell that allows the generated magnetic fields to easily pass therethrough without any substantial interference, so that the magnetic field will not unnecessarily cause the heating of the shell, but rather be more advantageously delivered to the metal contained within the crucible.

It is a further object of the present invention to provide an improved coil assembly and a ladle, having a metallic shell, for all types of induction furnaces including a vacuum type.

Further still, it is an object of the present invention to provide induction furnaces having means for removing the heat dissipated by the induction coil assembly without interfering with the electromagnetic fields generated thereby.

Other objects, advantages and novel features of the present invention will become apparent from the following detailed description of the invention when considered in conjunction with the accompanying drawings.

SUMMARY OF THE INVENTION

The present invention is directed to induction furnaces, each having an induction coil assembly comprising laminated iron yokes and a ladle with a metallic shell comprising non-magnetic bars. The induction coil assembly and the shell each contributes to improving the performance of the induction furnace. More particularly, the shell is arranged so as to not offer any substantial interference with the magnetic fields developed by the induction coil assembly, and the induction coil assembly provides for a concentrated and uniform distribution of the magnetic flux making up the magnetic field. Both the induction coil assembly and the shell allow the magnetic fields to be more advantageously used in creating eddy currents to heat the metal contained within each of the furnaces. The shell provides structural support for a crucible both of which comprise a ladle that is readily separated from the induction coil assembly so as to accommodate the convenient transport of the heated metal between various operational stations.

Each of the induction heating furnaces of the present invention includes an induction coil assembly comprising a coil, an upper, a lower and intermediate yokes. The induction coil assembly has a central axis and a preselected axially extending length. The upper and lower yokes are axially separated from each other by a predetermined distance and electromagnetically coupled together by the intermediate yokes. The crucible of the ladle holds the material to be heated by the furnace and has a preselected shape. The shell of the ladle surrounds and generally conforms to the shape of the crucible and comprises bars of non-magnetic material, and is located so as to be surrounded by, but not touching, the induction coil assembly. The shell extends past both the upper and lower yokes each by a respective preselected distance.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 5 is a schematic illustration of the perpendicular orientation of the magnetic field shown as entering and exiting the shell of the present invention.

FIGS. 6*a* and 6*b* illustrate various embodiments of the upper and lower yokes of the induction coil assembly of the present invention.

FIG. 7 is a partial-sectional view illustrating further details of the refractory liner of the ladle of the induction furnace of FIG. 1.

DETAILED DESCRIPTION OF THE PREFERRED EMBODIMENTS

Figure 10:
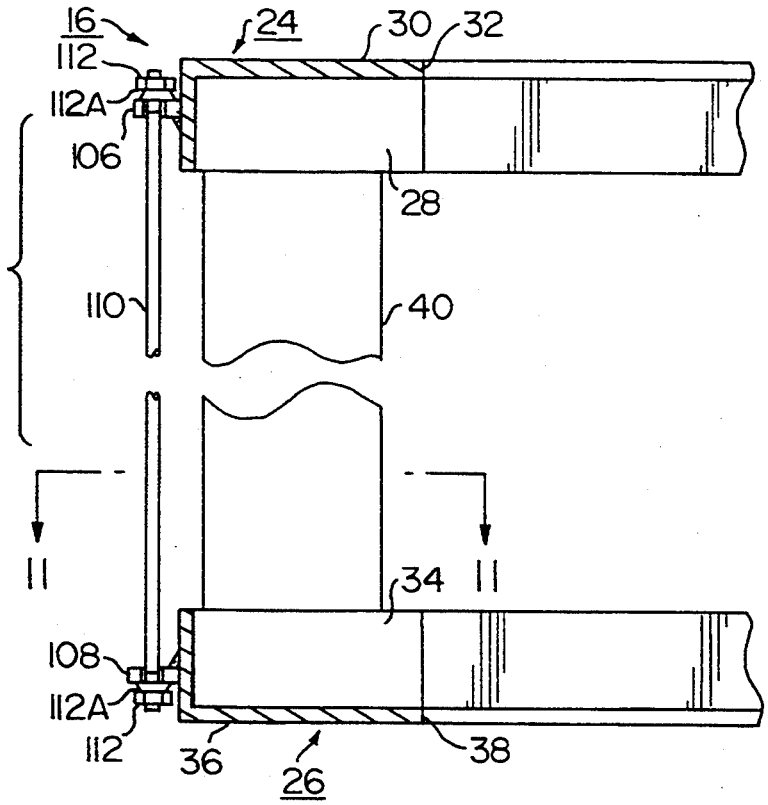
FIG. 10 illustrates further details of the yoke assembly of the present invention.
Figure 11:
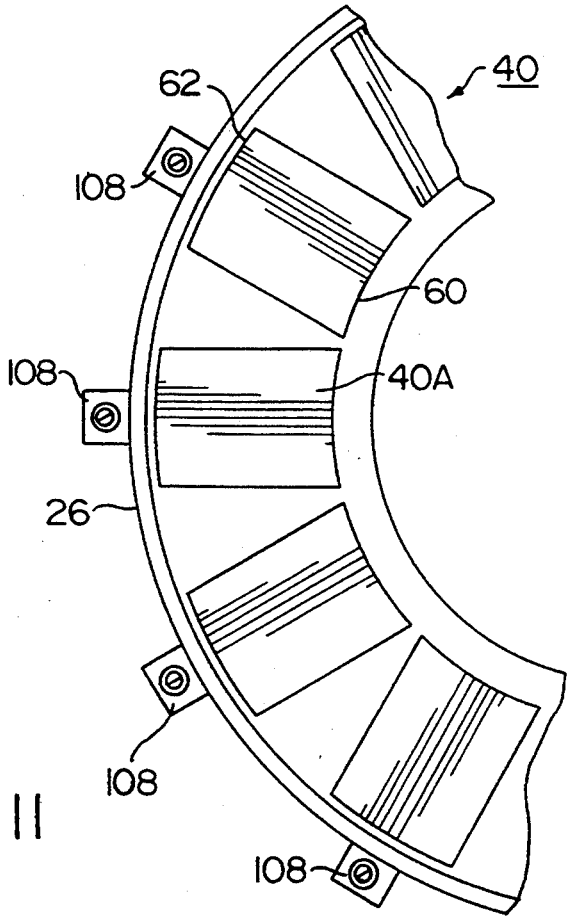
FIG. 11 is a view, taken along lines 11—11 of FIG. 10, showing the intermediate yoke of the induction coil assembly.
Figure 12:
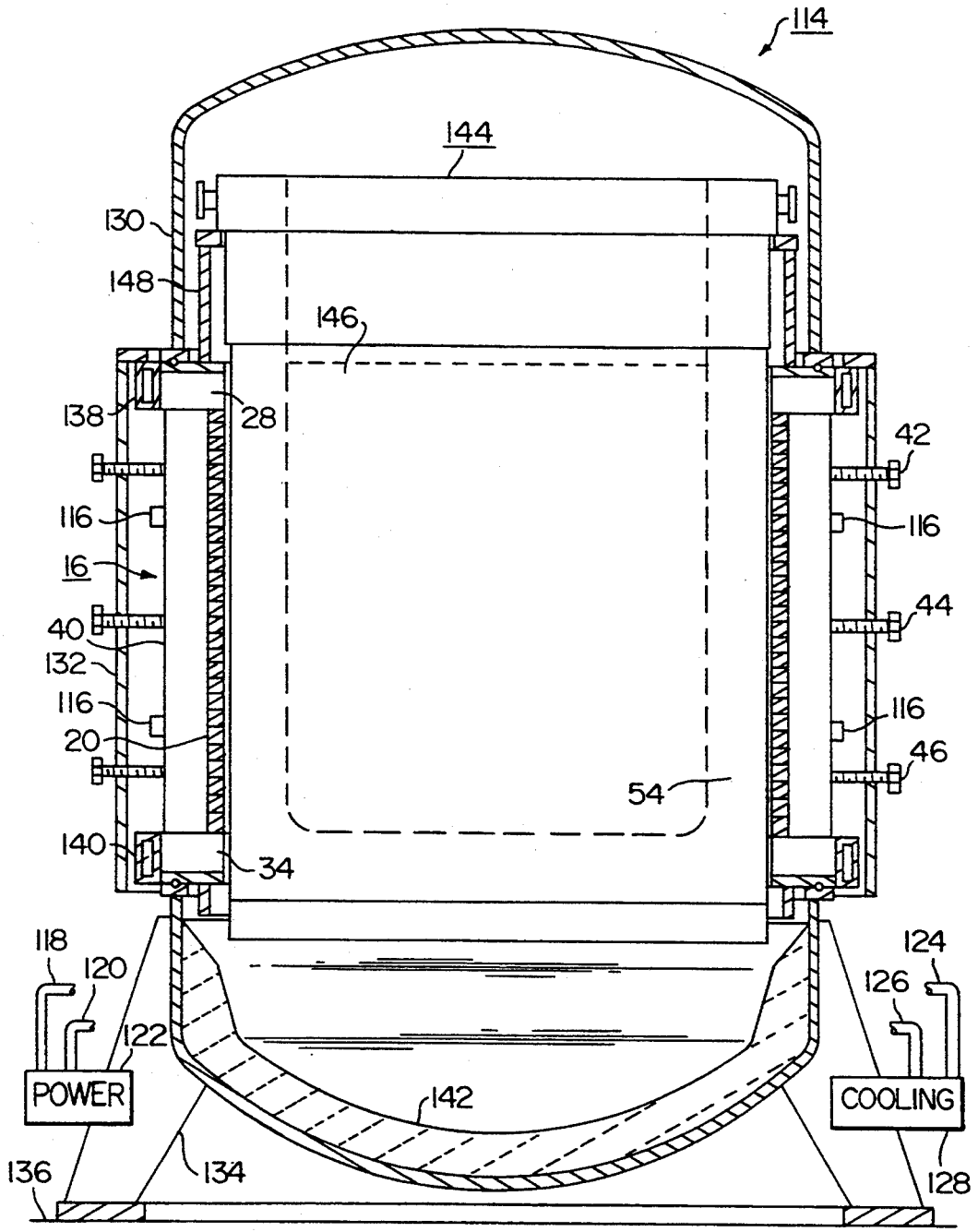
FIG. 12 is a longitudinal-sectional view of a vacuum induction furnace, in accordance with another embodiment of the present invention.
Figure 13:
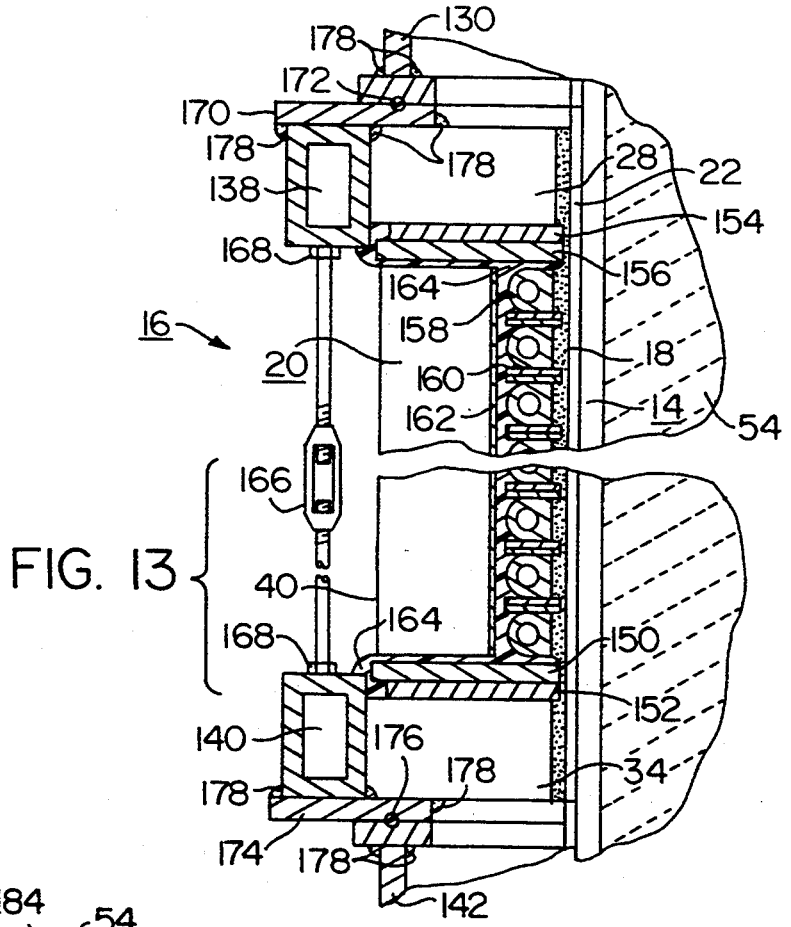
FIG. 13 illustrates further details of the cooling means and coil configuration related to the vacuum induction coil assembly.
Figure 14:
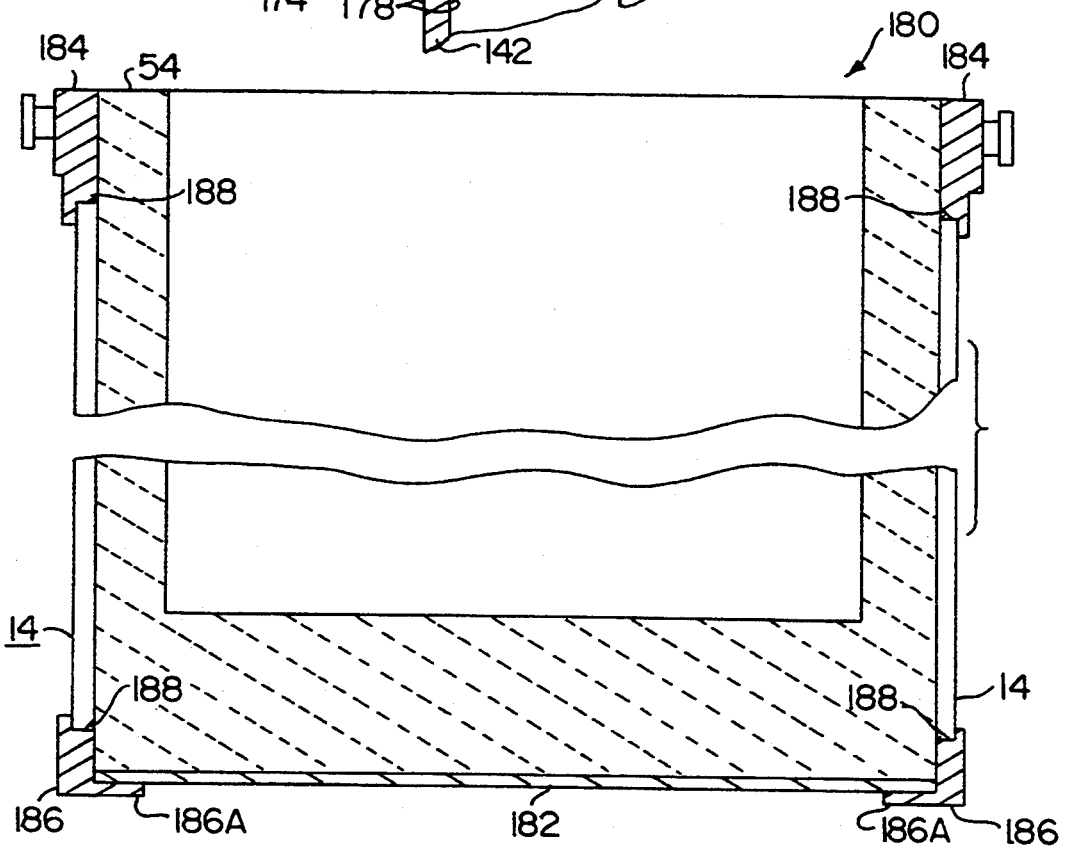
FIG. 14 illustrates a still further embodiment of the present invention that facilitates the removal of the liner of the ladle.
Figure 15:
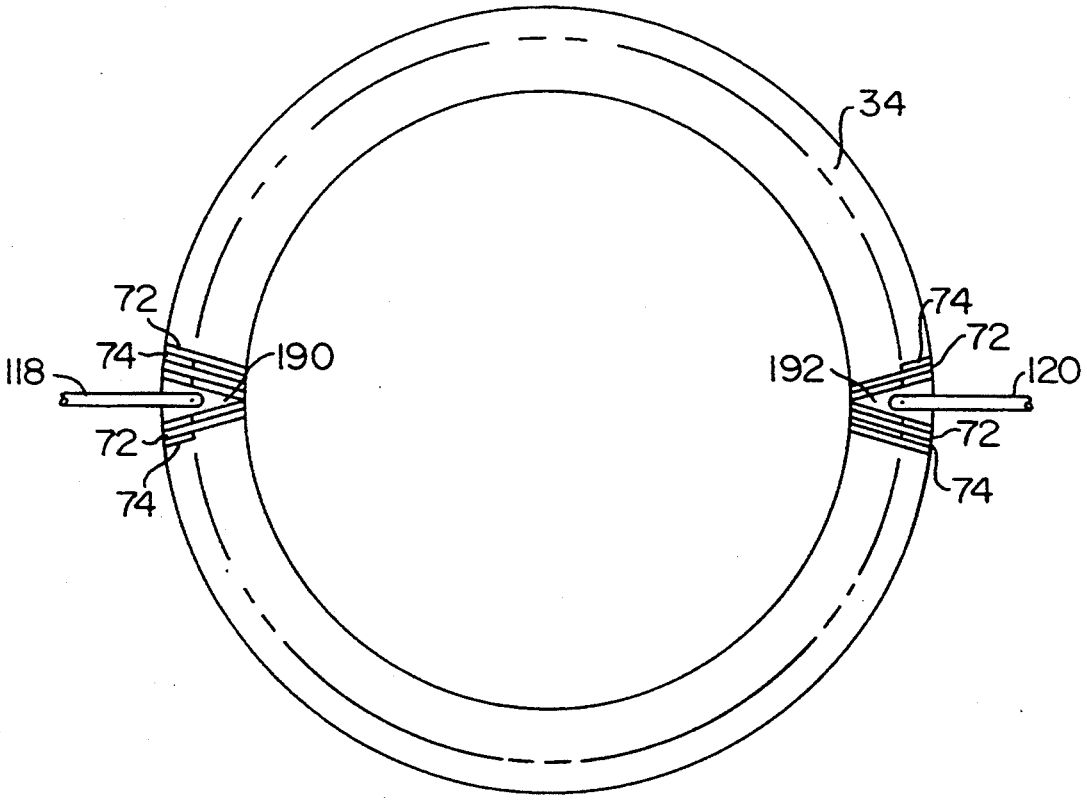
FIG. 15 illustrates an arrangement having ceramic members in the lower/upper yokes of the present invention for reducing cross-flux effects at the power termination areas of the furnace.

Referring now to the drawings, wherein like reference numbers indicate like elements, there are illustrated three embodiments of induction furnaces according to the present invention, with the first embodiment being shown in FIGS. 1–11 for an open-type induction furnace, the second embodiment shown in FIGS. 12 and 13 for a vacuum induction furnace, and the third embodiment being shown in FIG. 14 for either open or vacuum type induction furnace that provides for the easy removal of a refractory liner. FIG. 15 illustrates features of the invention that are common to all embodiments. In all of the FIGS. 1–15, where possible and for the sake of clarity, reference numbers and some elements are shown on only one side of the illustrated embodiment.

In general, the induction furnaces of the present invention comprise an induction coil assembly that surrounds, but does not touch, a ladle comprising a crucible for holding the material to be heated by the furnace and a shell that gives rigid mechanical support to the crucible. The ladle is readily removed from the induction coil assembly, so that the heated material therein may be conveniently and safely transported between various processing stations. The first embodiment of the present invention is designated in the figures as induction furnace 10. Induction furnace 10 is illustrated, partially in section, in FIG. 1, and comprises the elements listed in Table 1.

TABLE 1

| REFERENCE NUMBER | ELEMENT |
|---|---|
| 12 | ladle |
| 12A | upper annular casing of ladle 12 |
| 12B | lug of annular casing 12A |
| 12C | lower annular casing of ladle 12 |
| 14 | shell of ladle 12 |
| 16 | induction coil assembly |
| 18 | insulative layer of induction coil assembly |
| 20 | electrical coil of induction coil assembly |
| 22 | gap between insulative layer 18 and shell 14 |
| 24 | upper solid ring |
| 26 | lower solid ring |
| 28 | upper yoke |
| 30 | upper cover |
| 32 | weld between upper yoke 28 and upper cover 30 |
| 34 | lower yoke |
| 36 | lower cover |
| 38 | weld between lower yoke 34 and lower cover 36 |
| 40 | intermediate yoke |
| 42, 44 and 46 | yoke bolts |

The induction heating furnace 10 has a ladle 12 and a refractory liner (discussed in more detail with reference to FIG. 2), for holding material, such as metal, to be heated by the furnace. The ladle 12 also has an outer shell 14 (shown in phantom) formed of a non-magnetic material and which surrounds and generally conforms to the shape of the refractory liner.

The induction furnace 10 further comprises an induction coil assembly 16 having a central axis and a preselected axially extending length. The induction coil assembly 16 surrounds the shell 14, but is separated therefrom by an insulative layer 18 which contacts the coil 20 of the induction coil assembly 16, and an air gap 22 located between the shell 14 and the layer 18. The air gap 22 facilitates the removal or separation of the ladle 12 from the induction coil assembly 16 so that the ladle 12 may be conveniently transported between processing stations, as previously mentioned.

The induction coil assembly 16 further comprises an upper solid ring 24 and a lower solid ring 26. The upper solid ring 24 comprises upper yoke 28 and upper cover 30 which are mechanically connected together by suitable means, such as a weld 32. The lower solid ring 26 comprises lower yoke 34 and lower cover 36 which are also mechanically connected together by suitable means, such as a weld 38. The upper yoke and the lower yoke 34 are axially separated from each other by a predetermined distance and are electromagnetically coupled to each by the intermediate yoke 40.

The coil 20 is located, in a rigid manner, between upper and lower yokes 28 and 34, respectively, and in a radial direction between intermediate yoke 40 and the outer structure of the assembly 16. More particularly, the upper and lower yokes 28 and 34 are used to clamp coil 20 in an axial direction, and the intermediate yokes 40 are used to support the coil 20 in a radial direction by means of the tightening or squeezing action of yoke bolts 42, 44 and 46 forcing intermediate yoke 40 inward against the coil 20. As will be further described with reference to FIG. 8, thermal expansion compensation means are provided so as to allow coil 20 to expand in its axial dimension, while at the same time allow the upper and lower yokes to maintain their axial clamping action of the coil 20. The overall axially extending length of induction coil assembly 16, including all of its thermally expandable components, is less than that of the shell 14.

Further details of the induction furnace 10 may be described with reference to FIG. 2, which is a view taken along line 2—2 of FIG. 1, with the left side of FIG. 2 viewed with respect to location 48 of FIG. 1, and the right side of FIG. 2 viewed with respect to location 50 of FIG. 1. The left side of FIG. 2 shows further details of the upper yoke 28, whereas the right side of FIG. 2 shows further details of the intermediate yokes 40 as well as the electrical coil 20. The lower yoke 34 is not shown in FIG. 2, but it has the same structure as upper yoke 28. FIG. 2 further shows the shell 14 as being separated from the coil 20 by means of the insulative layer 18 and 22 gap. However, the shell 14 is in physical contact with a refractory liner 54.

Liner 54 may be of a refractory ceramic or an electrically conductive electromagnetic susceptor material, such as graphite. The liner 54, with structural support from. the shell 14, comprises the means for holding and containing the metal being heated by the induction furnace, and has an upper open end and a closed bottom end (not shown in FIG. 2).

As shown in FIG. 2, the first yoke 28 preferably having a cylindrical shape is shown as having related inner (56) and outer (58) diameters. Similarly, the intermediate yoke 40 is shown as having inner (60) and outer (62) diameters. The shell also preferably having a cylindrical shape is shown in FIG. 3.

Figure 3:
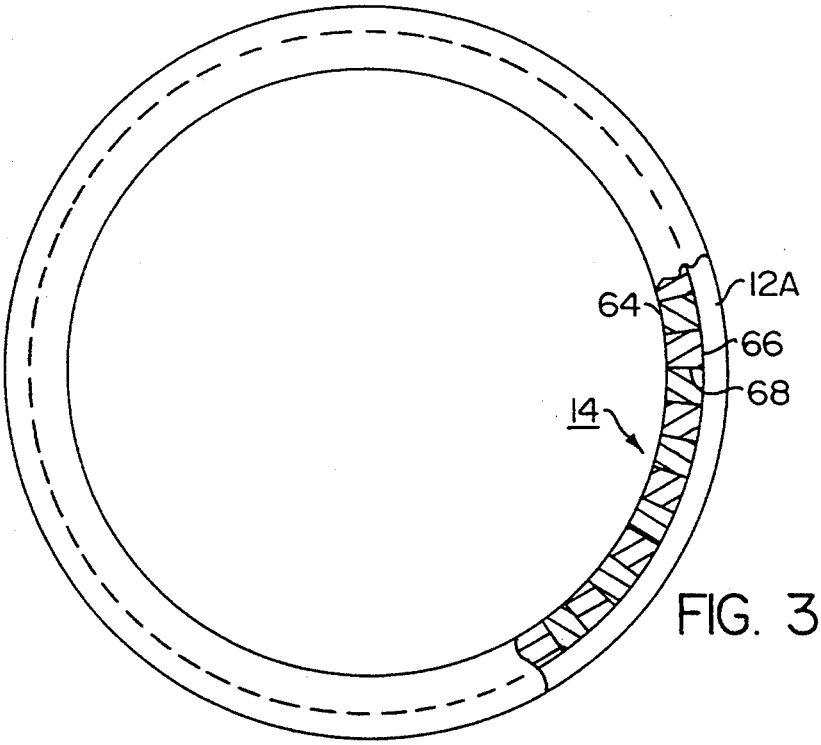
FIG. 3 illustrates the details of the shell of the ladle, which is of primary importance to the present invention.

As shown in FIG. 3, the shell 14 abuts up against the upper annular casing 12A and comprising bars 64 that are loosely placed together and circumferentially distributed about the periphery of refractory liner 54 (not shown), in a uniform manner. The bars 64 are mechanically and electrically connected to both annular casings 12A and 12C by appropriate means such as welding. The bars 64 have dimensions 66 and 68, with dimension 66 shown as being along the periphery of refractory liner 54 and dimension 68 shown as being perpendicular to the circumference of refractory liner 54. Bars 64 are formed of non-magnetic material, for example, stainless steel. The width of the bar 64, that is, dimension 66, is small in relation to the depth (D) of current penetration created by the operation of induction coil 20. Depth (D) of current penetration may be expressed by the following relationship:

$$D = 1.985\sqrt{\frac{\rho}{f}} \tag{1}$$

where p is the resistivity of the bar 64 and f is the frequency of operation of the power source that excites the coil 20. The present invention uses a sufficient number of bars 64 to reduce the voltage between the bars to a very low level, so as to allow the oxide film normally present on each bar 64 to serve as the electrical insulation between the bars 64. For example, the selected turn voltage, that is, the voltage selected to be impressed on the shell 14, may have a typical. value of 100 volts. Further, the shell 14 may typically comprise five hundred and twenty-three (523) bars 64 so that the voltage difference between each adjacent bar 64 is 100 volts/523=0.19 volts. This very low voltage difference allows for the use of the simple oxide film as an insulator. This relative low voltage difference may be further reduced by increasing the number of bars. If desired, the bars 64 can be treated by coating them with an insulating substance before the bars 64 are assembled into the shell 14.

Further, the length of each of the bars 64 should have a length that exceeds the preselected distance separating the upper and lower ring circular yokes 24 and 26. Each of the bars extend past both the upper and lower yokes 28 and 34, by a preselected distance which extent may be described with reference to FIG. 4.

Figure 4:
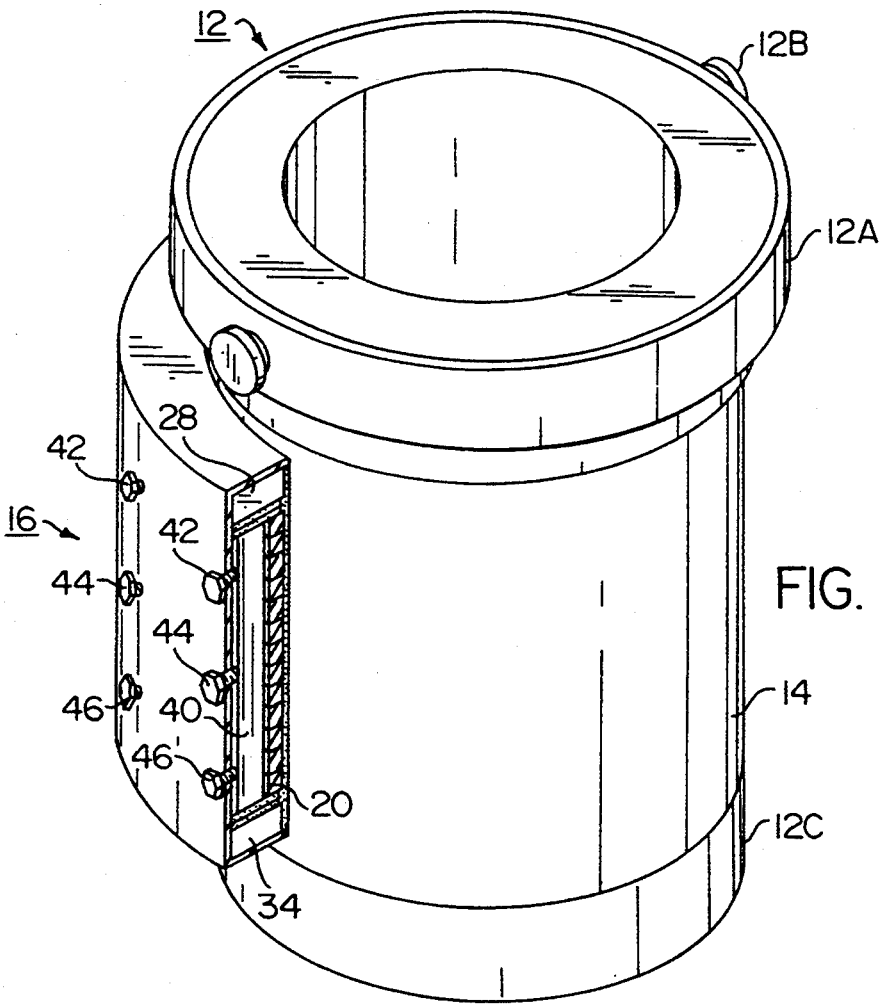
FIG. 4 is a schematic illustration showing the positional relationship between the induction coil assembly and the shell.

FIG. 4 is a schematic illustration showing a portion of the bars 64 vertically extending between the annular casings 12A and 12C. FIG. 4 further shows, in section, the inductive coil assembly 16 position near, but not touching the bars 64. The area formed by the vertical bars 64 is herein termed "power window," and as shown in FIG. 4, extends above and below the axial vertical extent of the induction coil assembly 16. The area formed along the ladle shell 14, corresponding to the separation between the top and bottom yokes 28 and 34, establishes what is herein termed a "ladle wall window."

As previously discussed, the bars 64 are of a non-magnetic material, have a width that is small compared to the depth of penetration of the currents created by the operation of coil 20, and have a voltage difference between their adjacent bars which is very low, typical of about 0.19 volts or lower. The low voltage difference substantially eliminates any flow of current between the bars 64, and the non-magnetic material of the bars 64 in cooperation with small depth of current penetration into the bars 64 cause the bars to act as low impedance paths to the magnetic field generated by the operation of coil 20. The overall effect of shell. 14 is to allow the magnetic field generated by coil 20 to pass easily through the window provided by the bars 64 and to be advantageously delivered to the metal being heated without suffering any noticeable loss. Because the bars 64 do not substantially interfere with the magnetic field, the self-heating effect ($I^2R$) of the shell is reduced which, in turn, prevents any substantial degradation to the mechanical integrity of shell caused by self-heating, thereby, allowing the shell to beneficially serve its intended purpose of providing mechanical support for the crucible 54. The non-interference of the shell with the magnetic field is further described with reference to FIG. 5.

Figure 1:
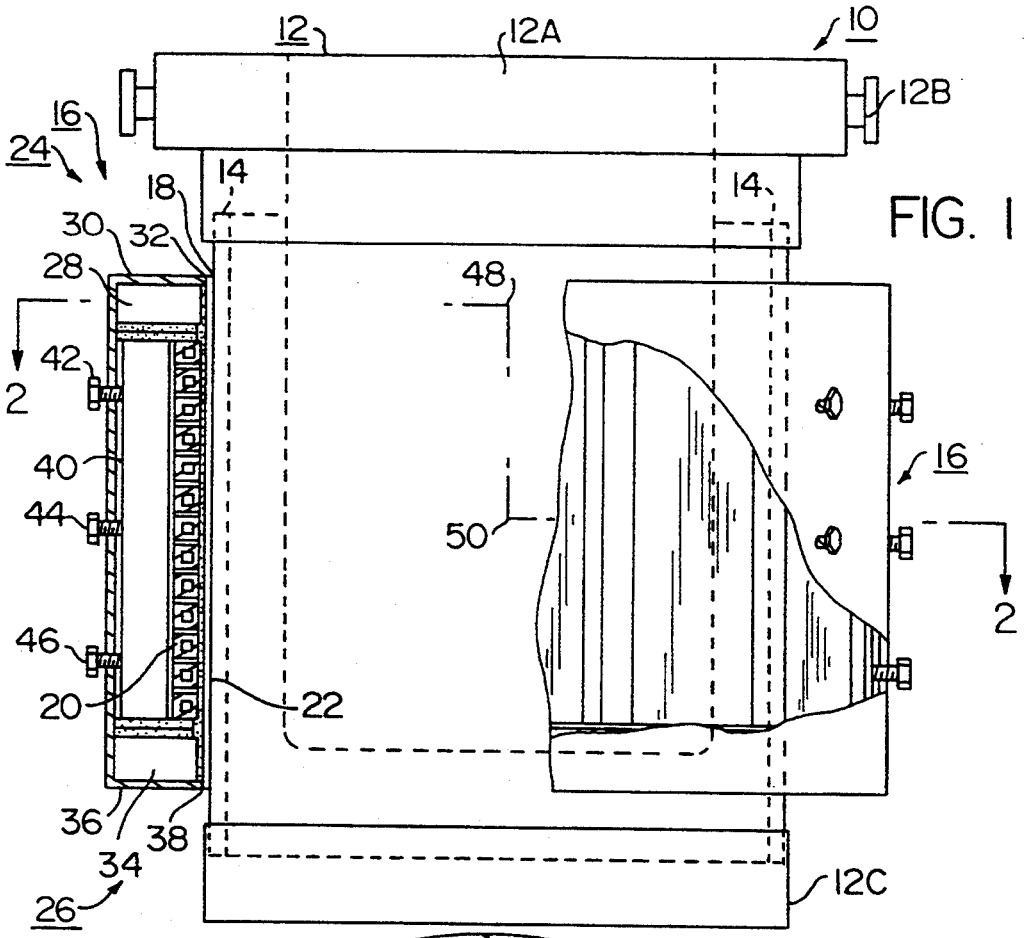
FIG. 1, partially shown in section so as to expose some of the elements of the induction coil assembly, is an illustration of a ladle induction furnace in accordance with one embodiment of the present invention.
Figure 2:
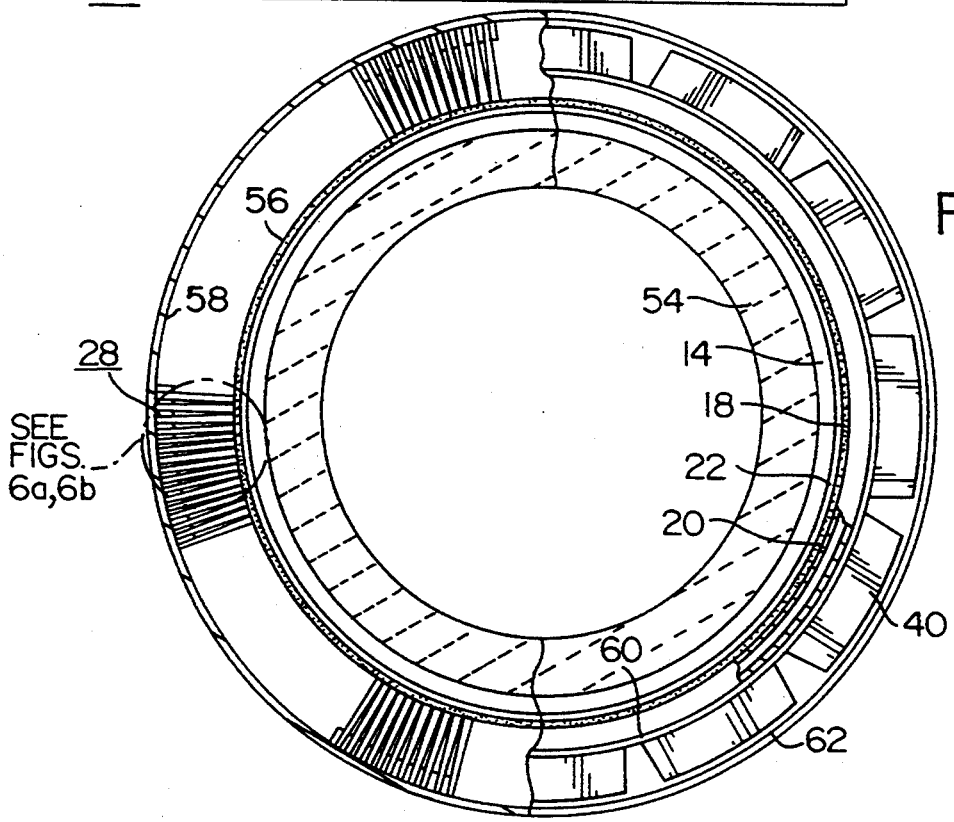
FIG. 2 is a transverse-sectional view of the induction furnace of FIG. 1, taken along lines 2—2 in FIG. 1.

FIG. 5 is similar to FIGS. 1 and 4 and shows a slice or plane of the induction coil assembly 16 so as to illustrate the orientation of the lines of force (flux) which collectively constitute a magnetic field 70 generated by induction coil assembly 16. It is important that the magnetic field 70 pass through the ladle shell 14 in a perpendicular manner. To accomplish such a passage, the top and bottom yokes 28 and 34 are installed above and below the induction coil 20. The placement and operation of the yokes 28 and 34 allow the magnetic field 70 to enter and exit through the same ladle wall window. Furthermore, by vertically placing the bars 64 of the shell 14 and extending them above and below the magnetic flux lines (confined and established within the ladle wall window), no voltage and consequently no current is generated in the bars 64 and the upper 12A and lower casings 12C, allowing them to be welded together into one structure 14.

With reference back to FIG. 4, these portions below the magnetic flux lines correspond to the portions of bars 64 below lower yoke 34 as well as the annular casing 12C itself, and those portions above the magnetic flux lines correspond to the portions of the bars 64 above upper yoke 28 as well as the annular casing 12A itself. Because no magnetic flux is present in these lower and upper portions, if desired, these portions may be formed of plain steel.

The magnetic field 70, shown in FIG. 5, creates the eddy currents in the metal charge within the furnace 10 which heat the metal charge. FIG. 5 illustrates the magnetic field 70 as being comprised of individual segments 70A, 70B and 70C, each shown by nearly straight-line portions, and individual segments 70D, 70E and 70F each shown by bowed-like portions. The magnetic field 70 generated by induction coil assembly 16 passes through the upper yoke 28 in an undisturbed manner, as shown by the nearly straight-line portion 70A, and returns through the lower yoke 34, also in an undisturbed manner, as shown by nearly straight-line portion 70B. The portions 70A and 70B also are shown as being coupled to each other by straight-line portion 70C which flows through the intermediate yoke 40.

It should now be appreciated that the practice of the present invention provides for an electromagnetic induction field 70 to be developed by the induction coil assembly 16 that couples into the metal without encountering any substantial interference from the shell 14. Both the shell 14 and induction coil assembly 16 contribute to the benefits yielded by the present invention. More particularly, the shell 14 and the induction coil assembly 16 advantageously direct and concentrate the electromagnetic induction field into its intended target; i.e., the metal contained in the crucible of the induction furnaces.

Further still, the ladle, made up by the crucible and shell, is readily removable from the induction coil assembly. Because the metal shell does not suffer from any substantially self heating (($I^2R$) losses), its mechanical integrity is not degraded and this metal shell provides for reliable mechanical support of the crucible allowing its heated metal to be conveniently and safely transported between various processing stations.

The upper, lower and intermediate yokes of the induction coil assembly 16 each comprise stacked laminates. The upper and lower yokes have embodiment such as those shown in FIGS. **6*a* and 6*b*, whereas the intermediate yoke has an embodiment to be discussed with reference to FIG. 11**.

FIG. **6*a* shows a first arrangement of laminates 72 and 74. Each laminate is made of a non-grain-oriented steel material, such as types M-36 and M-19. The laminate 72 has a transverse length which spans the inner diameter 56 and the outer diameter 58. The laminates 74 have a transverse length which is substantially less than the length of laminate 72. All of laminates 72 and 74 have a vertical height corresponding to the height of the yokes 28 and 34. The laminate 74 is arranged at the outer end of laminate 72 and positioned along and near the circumference of the outer diameter 58**. As used herein, the circumference is meant to represent the external boundary or surface defined by the diameter associated with the circumference. Similarly, the circumferential area or region, as used herein, is meant to represent the area defined by or located between one or more associated diameters.

The laminates 72 and 74 are arranged in a circular curve with the laminate 74 positioned in contact with laminate 72 as shown in FIG. **6*a*. The contacting points between laminates 72 and 74 are arranged along a diameter 76 (shown in phantom), that is intermediate between diameters 56 and 58**. The inner portion of laminates 72 is arranged along and near the circumference of inner diameter 56, whereas the outer portion of laminates 72 is arranged along and near the circumference of diameter 58. The smaller laminates 74 are each sandwiched between two of the larger laminates 72, and in a sequential manner.

A second embodiment of the circular yokes 28 and 34 is shown in FIG. 6*b*. The arrangement of FIG. 6*b* is similar to that of FIG. 6*a*, with the exception that two of the longer laminates 64 are stacked one upon the other. The outer portion of each of such stacked laminates 72 has the shorter laminate 74 placed thereon.

The laminates 72 and 74 of FIGS. 6*a* and 6*b*, each has a predetermined thickness. The total number of the laminates 72 and 74 is of a predetermined quantity so as to occupy, in a uniformly distributed manner, the majority of circumferential region between the inner diameter 56 and outer diameter 58 of the induction furnace 10. Stacking the ring yokes 28 and 34, with different length laminations allows to arrive at a circle of any desired radius to accommodate any induction furnace having the need for different diameters to provide for the necessary heating of different amounts of metal. This stacking results in a maximum "fill factor" which is meant to mean that a maximum number of laminates may be filled into any desired circumference of any given diameter.

The arrangement of the coil assembly 16 having the circular yokes 28 and 34 may be further described with. reference to FIG. 7. FIG. 7 has features similar to those illustrated in FIGS. 1 and 2 and more clearly shows the gap 22 between the insulative layer 18 and the ladle shell 14. The gap allows for the thermal expansion therebetween and also, as previously mentioned, facilitates the removal or separation of the ladle 12 from the induction heating assembly 16. Further, FIG. 7 shows the refractory liner 54 of FIG. 2 as having a working lining 84, a layer 86 of felt insulation and a backup lining 88. The working liner 84, as well as the backup lining 88 may comprise a mixture of suitable refractory materials such as MgO and $SiO_2$, etc. FIG. 7 further shows upper 12A and lower 12C annular casings mechanically and electrically connected to the shell 14 by suitable means such as welds 90. For the embodiment of FIG. 7, the lower annular casing 12C is also connected to the bottom plate 92 by welds 90 forming the ladle 12. Additional details of annular casings 12A and 12C, as well as other features of the induction furnace 10, may be described with reference to FIG. 8.

Figure 8:
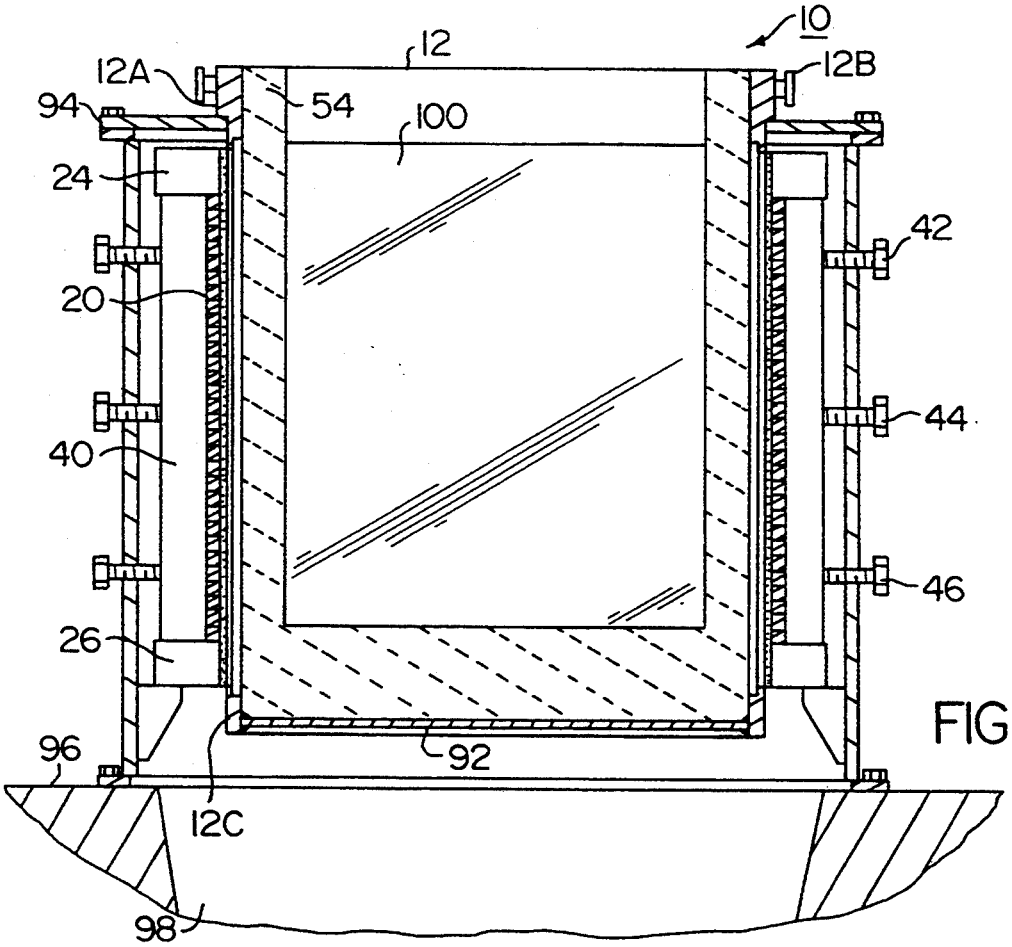
FIG. 8 is a sectional view illustrating further details of the induction furnace of FIG. 1.

FIG. 8 shows the upper annular casing 12A resting upon a support structure 94 of the outer housing of induction furnace 10 which, in turn, is resting upon a floor or ground 96. The induction furnace 10 of FIG. 8 is shown as being positioned over a commonly known "run-out pit" 98. The induction furnace 10 is further shown as holding or containing a metal charge 100 heated by induction coil assembly 16. The coil 20 of coil assembly 16 is clamped, in an axial direction, between upper and lower solid ring 24 and 26 which also embody the yokes 28 and 34, but allowed to thermally expand in its axial direction by the action of thermal expansion compensation means, common to all embodiments, and which may be of the type to be described with reference to element 112A of FIG. 10. The coil 20 of FIG. 8 is supported in its radially direction by intermediate yoke 40 being pressed against the coil 20 in response to the tightened yoke bolts 42, 44 and 46.

The induction coil assembly 16 being positioned on the outside of the ladle 12 is not subjected to forces from refractory expansion or from the static head of liquid metal in the ladle 10. However, forces such as magnetic forces on the coil 20 still exist and are compensated for by the present invention. More particularly, the two yoke rings 24 and 26 are part of the support structure of the induction coil assembly 16 and provide clamping of the coil 20 to reduce its operational movement. Further, the coil 20 itself is preferably pre-stressed which reduces its axial movement commonly caused by the operation alternating magnetic field and the thermal expansion of the coil 20 itself. In particular, internal stresses are introduced into the coil which more than counter the stresses that typically occur when the coil is subjected to magnetic forces that would otherwise cause axial movement, vibration and noise. In addition, the intermediate yoke 40 pressing against the coil 20, because of its related structural support members (42, 44, 46), provides radial clamping of the coil 20 which cooperatively assists the action of the axial clamping provided by solid ring yokes 24 and 26. In addition to these support features for coil 20, the thermal expansion of the shell 14, made up of the non-magnetic bars 64, should also be taken into consideration, and may be further described with reference to FIG. 9.

Figure 9:
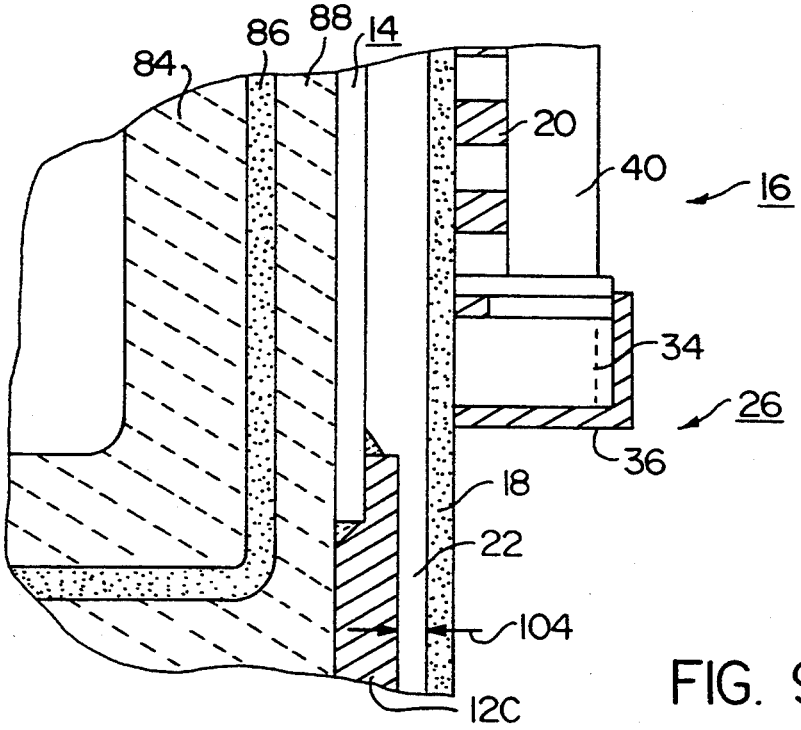
FIG. 9 illustrates a portion of FIG. 7 so as to show further details of the interconnections of the shell.

FIG. 9 is a partial-sectional view showing, in an enlarged manner, a portion of the elements illustrated in FIG. 7. The thermal expansion of shell 14 should be taken into account for the design of the insulative layer 18 as well as the selection of gap 22. More particularly, the gap 22, having a lower portion 104, should be provided between the insulative layer 18 and the annular casing 12C (also annular casing 12A not shown) which is welded to the shell 14. The thermal expansion of the shell 14 relative to the induction coil assembly 16 should also be taken into account. Further considerations related to the induction coil assembly 16 may be described with reference to FIG. 10.

FIG. 10 shows a typical assembly of the upper, lower and intermediate yokes as having attachment means 106 and 108 respectively connected to the upper (24) and lower (26) solid rings. The attachment means 106 and 108 are each provided with an opening so as to allow a bar member 110 to be inserted therebetween and connected to each device 106 and 108 by means of nuts 112. Each of the nuts 112 is tightened down onto a conical disc spring member 112A serving as the thermal, expansion means previously mentioned. Each of conical disc spring members 112A is respectively forced down against the attachment means 106 and 118. When the upper and lower rings 24 and 26 begin to be axially displaced because of the thermal expansion of the coil 20, the spring-like side walls of member 112A become bowed so as to move with the thermally expanding coil 20. These members 112A resiliently return to their original shape when the coil 20 returns to its non-expanded condition. The conical disk spring members 112A allow for axially clamping during all operating and non-operating conditions of coil 20. The connected bar member 110, on which the members 112A are placed maintains the alignment of the upper and lower yoke. The arrangement of the intermediate yoke 40 may be described with reference to FIG. 11, which is a view taken along line 11—11 of FIG. 10.

FIG. 11 illustrates a portion of the intermediate yoke 40 and as being positioned near the solid ring 26 having the attachment means 108. FIG. 11 further shows the intermediate yoke 40 as comprising groups of stacked laminates 40A circumferentially arranged in a uniform distribution and separated from each other. The laminates 40A comprising the straight yoke 40 are grain-oriented and may comprise electrical steel, such as types M-5 and M-6. Further, the laminates 40A have related inner (60) and outer (62) diameters which are respectively different than the inner (56) and outer (58) diameters of the circular yokes 28 and 34 of coil assembly 16 of the furnace 10 of FIG. 1.

A second embodiment of the present invention, employing many of the features of furnace 10, is shown in FIG. 12 for a vacuum induction furnace 114. The vacuum furnace 114 houses the induction coil assembly 16 shown in FIG. 10 as having circular straps 116 which hold the intermediate yoke 40 as well as its laminates 40A in place for assembly. The vacuum furnace 114 is provided with connections (not shown, but to be further described with reference to FIG. 15) to receive power cables 118 and 120 of power source 122 and cooling hoses 124 and 126 of cooling source 128.

The vacuum furnace 114 has an upper portion 130 of its housing which serves as its top enclosure. The upper portion 130 rests on the yoke and coil assembly 16 which, in turn, is interconnected to a base support portion 134 which rests upon flooring or ground 136. The central portion 132 has provisions such as yoke bolts 42, 44 and 46 for supporting the induction coil assembly 16. These provisions as well as the structural members to support bolts 42, 44 and 46 are also applicable to the other embodiments of the invention. Further, the upper and lower yokes have provisions 138 and 140, which are also applicable to the other embodiments, and that provide coolant for the furnace 114 including the vacuum seals 172 and 176 shown most clearly in FIG. 13. The induction furnace 114 shown in FIG. 12 further comprises a lower portion 142 serving as its bottom portion and formed of a refractory material. The furnace 114 further has a ladle 144 which contains a molten metal charge 146. The ladle 144 rests upon a vertical support member 148 of the housing of furnace 114 located above the induction coil assembly 16. The arrangement of coil assembly 16 within the furnace 1114 may be further described with reference to FIG. 13.

FIG. 13 shows the coil assembly 16 as positioned between a plurality of rings 150, 152, 154 and 156 in which rings 150 and 152 are arranged as one pair, and rings 154 and 156 are arranged as another pair. The rings 150 and 152 are preferably of a fiber glass-epoxy material and provide separation between the lower yoke 34 and the electrical coil 20. Similarly, the fiber glass-epoxy rings 154 and 156 provide separation between the upper yoke 28 and the electrical coil 20. The coil 20 is a continuous conductor 1.58 wound about, but not touching the shell 14. The conductor 158 has adjacent turns that are separated from each other by insulative segments 160. For the embodiment shown in FIG. 13, related to a vacuum induction furnace 114, the conductor 158 is separated from a sheet 162 of mica material by means of layer 164 of silicone rubber, preferably of the RTV type. The mica sheet 162 is located between the vertical yoke 40 and the RTV layer 164 which covers the coil 20 and yokes 28 and 34. As shown in FIG. 13, the silicon rubber layer 164 covers epoxy rings 150 and 156 and also covers the outer regions of all rings 150, 152, 154 and 156 which face outward toward the atmosphere. Also, the silicon rubber layer 164, in contact with mica sheet 162, covers all of the portions of the conductor 158 that face outward toward the atmosphere.

The continuous conductor 158 covered by layer 164, is shown in FIG. 13 as having a D-like shape, but it may also have a rectangular shape such as that generally shown in FIG. 12, or other type shapes. The conductor 158 has a central or hollow portion through which a coolant, such as water, may be circulated and, thereby, remove or carry away heat from the continuous conductor coil 158.

The inductive coil assembly 16 of FIG. 13 is provided with a turn-buckle arrangement 166, so as to hold the assembly 16 together, especially during the movement thereof. The turn-buckle arrangement 166 has its upper and lower ends respectively connected to the cooling chambers 138 and 140 by means of a nut type fastener 168. The top cover member 130 (partially shown) of the vacuum furnace 114 is mated to a frame member 170, connected to a cooling chamber 138, by means of an O-ring 172. Similarly, the bottom member 142 (partially shown) is mated to the frame 174, connected to chamber 140, by means of O-ring 176. The O-rings 172 and 176 assist in providing a sealed or vacuumized environment for the operation of furnace 114. The furnace 114 has a plurality of welds 178, some of which are shown in FIG. 13, for uniting its metallic components.

A still further embodiment of the present invention is shown in FIG. 14 for a ladle 180 having a removable bottom plate 182. FIG. 14 is similar to FIG. 8, except that it only shows some of the elements of FIG. 8, and it shows them in an enlarged manner. The ladle 180 of FIG. 14 comprises an upper ring 184 and a bottom ring member 186 having a flange portion 186A upon which the bottom plate 182 rests. The upper ring 184 is attached to the shell 14 by means of welds 188. The bottom ring 186 is also attached to the shell 14 by means of welds 188, however the bottom plate 182 is not welded to the bottom ring 186.

The ladle 180 facilitates or accommodates the relining process commonly occurring for ladles used in inductive furnaces. More particularly, the refractory liner 54 may be removed by exerting an upward force on the bottom plate 182 and continue such force so that the refractory liner 54 is pushed out and exits from the top region of the ladle 180. To insert or replace the refractory liner 54, the bottom plate 182 is first installed, followed by the refractory liner 54.

It should now be appreciated that the practice of the present invention provides for the convenient removal and replacement of the refractory liner of the ladle.

The one piece bottom plate 182 is advantageous in that it allows for more space to accommodate the mounting of slide gates or porous plugs associated with controlling the outflow of the molten metal from within the induction furnaces of the present invention.

Further, all of the embodiments of the present invention have the induction coil assembly 16 located external. to the shell 14 so that the internal portions of the furnaces are devoid of any electrical insulation, thereby allowing for the inductive furnaces to be completely welded or fabricated as a cast structure and, moreover, reducing the cost of the furnace, while at the same time allowing for greater strength of the furnaces for containing the molten metal.

The present invention also provides for the elimination of any cooling devices that interfere with the electromagnetic induction field generated by the induction coil assembly 16. More particularly, as seen in FIG.. 13, the chambers 138 and 140 that provide cooling of the assembly 16, are physically located away from the electrical coil 20, and therefore do not interfere with the magnetic fields created or induced by the coil 20 of assembly 16. The cooling ducts 138 and 140 may be provided with a cooling fluid such as water, so as to carry away the heat from the general region of each of the first circular yoke 28 and second circular yoke 34.

As also shown in FIG. 13, the coil assembly 16 is provided with seals making it vacuum tight for vacuum furnace applications. For such applications, the power leads, such as conductors 118 and 120 shown in FIG. 12, are placed on the outside of the vacuum chamber, thereby permitting the use of higher power supply voltages to be applied to these leads. which, in turn, decreases the cost of the power supply, such as power supply 122 of FIG. 12, needed to operate such induction furnaces. Further, the vacuum sealing of the induction coil assembly 16 of FIG. 13 keeps any contamination away from the electrical coil 20 which, as a result, reduces the amount of maintenance normally performed on such coils. Still, the induction coil assembly 16 of all embodiment has reduced losses related to its power connections and may be described with reference to FIG. 15.

FIG. 15 shows the lower yoke 34 as having the laminates 72 and 74 previously discussed with reference to FIG. 6*a*. FIG. 15 further shows oppositely positioned non-magnetic, ceramic wedges 190 and 192 over which pass power cables 118 and 120 respectively. The locations of these wedges 190 and 192 are not confined to their shown positions, but may be separated with one wedge on lower yoke 34 and the other wedge on upper yoke 28, or may both be located on upper yoke 28. The locations of the wedges 190 and 192 are primarily determined by the location of the connections (not shown) of the power cables 118 and 120 to their respective power terminals which, in turn, are connected to opposite ends of the coil 20 at the coil termination areas.

The wedges 190 and 192 are placed at or near respective coil termination areas to reduce losses from cross flux, relative to the interaction between the yokes and coil, in the coil termination area. Further, the ceramic wedges 190 and 192 are installed by being forced to the center of the yokes 28 and 34, thereby advantageously holding the laminations in place under compression.

The present invention, in particular the intermediate yoke 40, further improves the efficiency of the energy delivered to the metal, previously discussed with reference to FIGS. 4 and 5, because this yoke covers most of the outside area of the coil, and thereby reduces the related cross flux that would otherwise enter the side of the yokes as well enter into the upper and lower yokes. The reduction of this stray flux that may be present on the outside of the coil assembly also has the beneficial effect of improving operator safety by reducing the flux to which he/she may be possibly subjected.

It should be further appreciated, that by using all. metallic components for the shell 14, the shell can be fabricated (welded) into one complete ladle shell. Furthermore, the present invention satisfies its overall aims for an induction furnace by having a fairly uniform distribution of the magnetic field, by focusing this field into the proper direction within the ladle, by keeping any stray flux related to this magnetic field at the outside of the furnace to a minimum, by optimizing efficiency, and, furthermore, by combining the electrical and mechanical components of the furnace into one solid structure. Further still, by having the coil and yoke rings of the induction coil assembly of the present invention arranged into a complete assembly allows for sealing (silicon rubber covering) of the assembly as a unit so as to provide a vacuum tight structure. This unitary sealing has the advantages of eliminating the need for an additional. vacuum chamber while allowing power connections to the coil to be on the outside of the vacuum environment. These advantages make for easy access to the furnace and allow for the operation of the furnace at higher voltages compared to the operation of standard vacuum furnaces.

The present invention may be embodied in other specific forms without departing from the spirit or essential attributes thereof and, accordingly, reference should be made to the appended claims, rather than to the foregoing specification, as indicating the scope of the invention.

What we claim is:

1. An induction heating furnace comprising:

(a) an induction coil assembly having a central axis and a preselected axially extending length, said induction coil assembly comprising a coil, an upper, a lower and an intermediate yoke, said upper and lower yokes being axially separated from each other by a predetermined distance and electromagnetically coupled together by said intermediate yoke; and (b) means for holding a material to be heated by said furnace-comprising a crucible, having a preselected shape, and a shell surrounding and generally conforming to said shape of said crucible, said shell comprising bars of non-magnetic metallic material and located so as to be surrounded by, but not touching, said induction coil assembly, said shell extending past both said upper and lower yokes each by a respective preselected distance.

2. An induction heating furnace according to claim 1, wherein said upper, lower and intermediate yokes each comprises stacked laminates formed of sheets of ferrous material.

3. An induction heating furnace according to claim 2, wherein said upper and lower yokes comprise laminates of a non-grain-oriented electrical steel material, and said intermediate yoke comprises laminates of a grain-oriented electrical steel material.

4. An induction heating furnace according to claim 1, wherein said crucible, said shell, and said upper and lower yokes, all have a cylindrical shape.

5. An induction heating furnace according to claim 1, wherein said bars have opposite ends respectively joined to top and bottom rings respectively positioned above and below said upper and lower yokes.

6. An induction heating furnace according to claim 5, wherein each of said bottom rings has a flange.

7. An induction heating furnace according to claim 5, wherein said holding means further comprises a bottom plate resting on said flange of said bottom ring.

8. An induction heating furnace according to claim 1, wherein said upper and lower yokes are separated from said coil by at least one respective insulative segment and said intermediate yoke is also separated by said coil by at least a sheet of dielectric material.

9. An induction heating furnace according to claim 1, further comprising upper and lower covers respectively connected to said upper and lower yokes.

10. An induction heating furnace according to claim 1, wherein said induction coil assembly is separated from said shell by a layer of insulative material and an air gap.

11. An induction heating furnace according to claim 10, wherein said layer of insulative material is of grout material.

12. An induction heating furnace according to claim 8, wherein said coil has a layer of silicon rubber material separating the coil from said sheet of dielectric material.

13. An induction heating furnace according to claim 1, wherein said coil is pre-stressed by said upper and lower yokes so as to reduce its operational movement, vibration and noise.

14. An induction heating furnace according to claim 1, wherein:

(a) said upper and lower yokes each has substantially the same inner and outer diameter dimensions referenced to said central axis; and (b) said intermediate yoke has an inner diameter which is greater than that of said inner diameter dimension of said upper and lower yokes, said intermediate yoke also has an outer diameter which is less than the outer diameter dimension of said upper and lower yokes.

15. An induction heating furnace according to claim 14, wherein said upper and lower yokes: comprise an arrangement of stacked laminates, having (a) groups of first and second sheets each having different lengths and with the length of the second sheets being less than the length of the first sheets; and (b) sequential and repeating arrangements of a pair of said first sheets and then a single one of said second, sheets wherein each of said second sheets is sandwiched between multiples of pair of said first sheets, each of said first multiples sheets having their width spanning said inner and outer diameter dimensions of said upper and lower yokes, and each of said second sheets having one of its ends coinciding with a circumference defined by said outer diameter dimension.

16. An induction heating furnace according to claim 14, wherein said upper and lower yokes comprise an arrangement of stacked layers, having:

(a) groups of first and second sheets having different lengths and with the length of the second sheets being less than the length of the first sheets; and (b) sequential and repeating arrangements of one of said first sheet and then one of said second sheet, each of said first sheet having a width spanning said inner and outer diameter dimensions of said upper and lower yokes, and each of said second sheets has one of its ends coinciding with a circumference defined by said outer diameter dimension.

17. An induction heating furnace according to claim 15, wherein at least one of said upper and lower yokes includes at least one non-magnetic wedges therein having provisions for accepting a power cable for operation of said coil.

18. An induction heating furnace according to claim 16, wherein each of said upper and lower yokes further comprises one or more ceramic wedges located at areas of said induction coil assembly having provisions for accepting a power cable for operating said coil.

19. An induction heating furnace according to claim 14, wherein said intermediate yoke comprises groups of sheets each having the same length and spanning said inner and outer diameter dimensions of said intermediate yoke, said groups being uniformly distributed about the region of a circumference defined by said inner and outer diameter dimensions of said intermediate yokes.

20. An induction heating furnace according to claim 1, further comprising an upper member serving as a top portion, a central portion, and a lower member serving as a bottom portion, said top, central and lower portions being mated together by sealing members, said upper member, central portion and lower member providing a sealed environment for said induction furnace allowing it to serve as a vacuum type induction furnace.

21. An induction heating furnace according to claim 20, wherein said sealing members comprise O-rings.

* * * * *